United States Patent [19]

Roccaforte

[11] Patent Number: 4,518,086

[45] Date of Patent: May 21, 1985

[54] REINFORCED DISPLAY CARTON AND BLANK THEREFOR

[75] Inventor: Harry I. Roccaforte, Western Springs, Ill.

[73] Assignee: Champion International Corporation, Stamford, Conn.

[21] Appl. No.: 570,989

[22] Filed: Jan. 16, 1984

[51] Int. Cl.[3] ..... B65D 75/02; B65D 65/16

[52] U.S. Cl. ..... 206/485; 206/489; 206/806; 248/152

[58] Field of Search ..... 206/485, 492, 806, 489, 206/434; 248/152; 229/40

[56] References Cited

U.S. PATENT DOCUMENTS

| | | | |
|---|---|---|---|
| 2,713,451 | 7/1955 | Williamson et al. | 229/40 |
| 2,801,001 | 7/1957 | Wolowicz | 206/434 |
| 2,837,262 | 6/1958 | Ullrich | 229/40 |
| 3,005,546 | 10/1961 | Sanford | 206/434 |
| 3,185,292 | 5/1965 | Maro | 248/152 |
| 3,241,660 | 3/1966 | Cathcart, Jr. et al. | 248/152 |
| 4,191,289 | 3/1980 | Austin | 206/485 |
| 4,201,294 | 5/1980 | Roccaforte | 206/485 |
| 4,437,606 | 3/1984 | Graser | 206/434 |

*Primary Examiner*—William T. Dixson, Jr.
*Assistant Examiner*—Brenda J. Ehrhardt
*Attorney, Agent, or Firm*—Evelyn M. Sommer; William W. Jones

[57] ABSTRACT

A display package is formed by a carton which is wrapped around a container. The carton has a top panel, upper panels extending from the top panel, side panels depending from the upper panels and a bottom panel coupled to the side panels along its edges remote from the upper panels. Lower openings are formed in the side panels adjacent the bottom panels, while upper openings are formed in the upper panels adjacent the top panel. Reinforcing flaps extend from opposite side edges of the upper panels and the side panels, and overlie and are secured to surfaces of the upper and side panels adjacent their openings to reinforce lateral edges of the openings. The container is mounted in the carton above the bottom panel, between the side panels and below the top panel and upper panels and is secured by its top extending through the upper openings and its bottom extending through the lower openings.

2 Claims, 6 Drawing Figures

REINFORCED DISPLAY CARTON AND BLANK THEREFOR

BACKGROUND OF THE INVENTION

1. Field of the Invention

The present invention relates to a display carton for a container, a display package including the carton and container, and a unitary blank for forming the display carton. More particularly, the present invention relates to a wrap-around display carton with openings for receiving the top and bottom portions of the container, which openings are reinforced adjacent their lateral ends by flaps to prevent tearing of the carton.

2. Description of the Prior Art

Conventional wrap-around display cartons are not reinforced adjacent their openings, and thus, tend to tear at the lateral edges of the openings. A typical or standard wrap-around display carton comprises upper, inclined panels extending from a top panel, side panels depending from the upper panels and a bottom panel connecting the bottom edges of the side panels remote from the upper panels. Lower openings are formed in the side panels adjacent the bottom panel, while upper openings are formed in the upper panels adjacent the top panel. The upper and lower openings receive the top and bottom of the container to retain the container within the carton.

Conventional cartons of this type provide an effective mechanism for displaying the container by hanging the package, including the carton and container, by a suitable coupling formed in the top panel. However, these cartons are weak adjacent the largest sections of the openings (i.e., the minimum width portions of the carton) which sections are located adjacent the junctions between the top panel and the upper panels and between the side panels and the bottom panel. The carton at these points is further weakened by fold lines provided at these locations. Due to the weakness at these critical locations, the conventional display cartons tend to tear. Tearing at these locations loosens the attachment of the carton to the container and can permit the container to become completely dislodged from the display carton.

SUMMARY OF THE INVENTION

An object of the present invention is to provide a display carton, a display package including a display carton and container, and a unitary blank for forming a display carton in which the portions of the container adjacent the widest portions of the openings are strengthened by reinforcing flaps.

Another object of the present invention is to provide a display carton, a display package and a unitary blank for forming a display carton which can be reinforced adjacent the lateral sides of its opening without complex folding and gluing machinery.

Another object of the present invention is to provide a display carton, a display package and a unitary blank for forming a display carton which are of rugged construction and which are simple and inexpensive to manufacture and assemble.

The foregoing objects are obtained by a display package for a container comprising a top panel, first and second upper panels extending from the top panel, first and second side panels depending from the first and second upper panels, respectively, and a bottom panel coupled to the side panels along their edges remote from the upper panels. First and second lower openings are formed in the first and second side panels, respectively, adjacent the bottom panel. First and second upper openings are formed in the first and second upper panels, respectively, adjacent the top panel. The panels, at the lateral ends of the openings, are reinforced by reinforcing flaps. The reinforcing flaps extend from opposite side edges of the upper panels and side panels, and overlie and are secured to surfaces of the upper panels and side panels adjacent the openings.

The foregoing objects are also obtained by a blank for forming a display carton housing a container, comprising a bottom panel, side panels, upper panels, and top panels. The first and second side panels extend from and are hingedly coupled to opposite end edges of the bottom panel along fold lines. The first and second upper panels extend from and are hingedly coupled to end edges of the first and second side panels, respectively, remote from the bottom panel along fold lines. First and second top display panels extend from and are hingedly coupled to end edges of the first and second panels, respectively, remote from the side panels along fold lines. First and second lower openings are formed in the first and second side panels, respectively, adjacent the bottom panel, which openings are spaced from the side edges of the side panels by first distances. First and second upper openings are formed in the first and second upper panels, respectively, adjacent the top panel, which upper openings are spaced from side edges of the upper panels by second distances. Reinforcing flaps extend from and are hingedly coupled to opposite side edges of the upper and side panels along fold lines. The widths of the flaps perpendicular to their fold lines are substantially at least as great as the respective first and second distances.

By forming the carton and blank therefor in this manner, the portions of the carton adjacent the lateral sides of the openings are reinforced simply and inexpensively. The weakened panels are reinforced by flaps formed as unitary portions of the carbon and blank, which flaps are folded over and secured against the surfaces of the upper and side panels providing a double thickness of carton material along the lateral sides of the carton.

A container displayed within the carton with its top extending through the upper openings and its bottom extending through the bottom openings will be securely retained within the carton. The flaps will prevent the carton from tearing at the openings. Additionally, the folding of the reinforcing flaps against the side and upper panels provides rounded edges on the lateral sides of the carton avoiding sharp cut edges on the carton.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF PREFERRED EMBODIMENTS OF THE INVENTION

Figure 1:
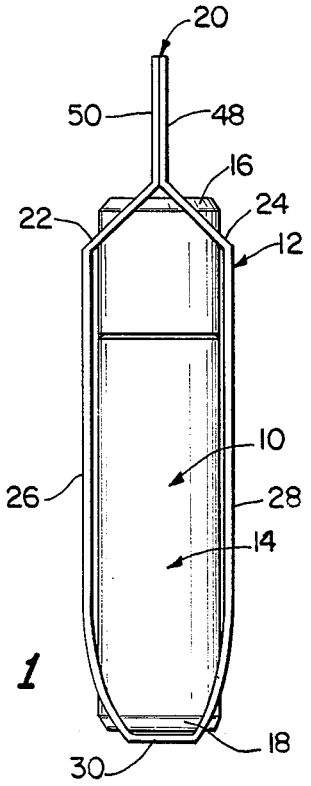
FIG. 1 is a side elevational view of a display package including a display carton and container according to the present invention.
Figure 2:
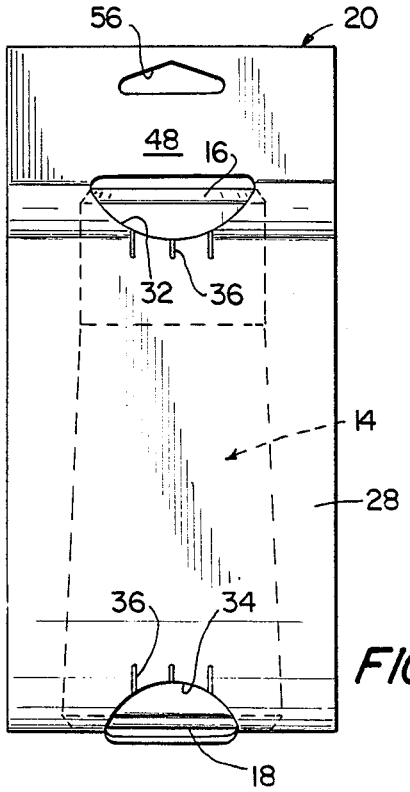
FIG. 2 is a front elevational view of the display package of FIG. 1.

Referring initially to FIGS. 1 and 2, the display package 10 of the present invention comprises a display carton 12 and a container 14. The illustrated container is generally elongated and cylindrical, although any suitable container shape may be used with the carton. The container has a top 16 and a bottom 18.

The display carton includes a number of panels which are wrapped around the container and are secured to the container. Basically, the carton comprises a top panel 20, first and second upper panels 22 and 24, first and second side panels 26 and 28, and a bottom panel 30. The upper panels extend from the top panel and are inclined at acute angles relative to the top panel. The side panels depend from the upper panels and are generally parallel to one another. The bottom panel is coupled to the bottom edges of the side panels, i.e., the edges remote from the upper panels.

Upper openings 32 are formed in the upper panels for receiving container top 16, while lower openings 34 are formed in the side panels, adjacent the bottom panel, for receiving container bottom 18. The container top and bottom extend through these openings securing the container within the display carton. Suitable slits 36 can extend from the openings 32 and 34 to facilitate expansion of the carton material around the container shape.

Figure 3:
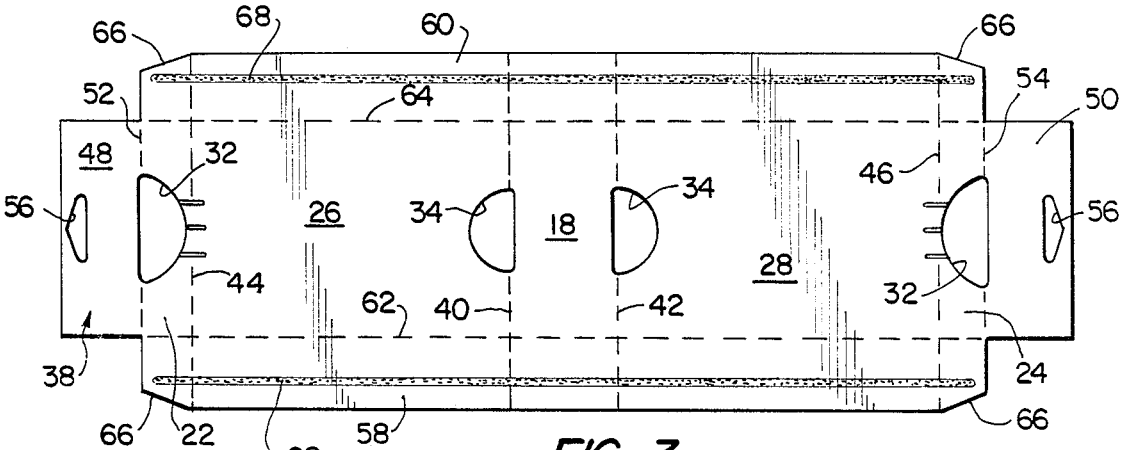
FIG. 3 is a top plan view of a blank for forming the display carton of FIG. 1, according to a first embodiment of the present invention.
Figure 4:
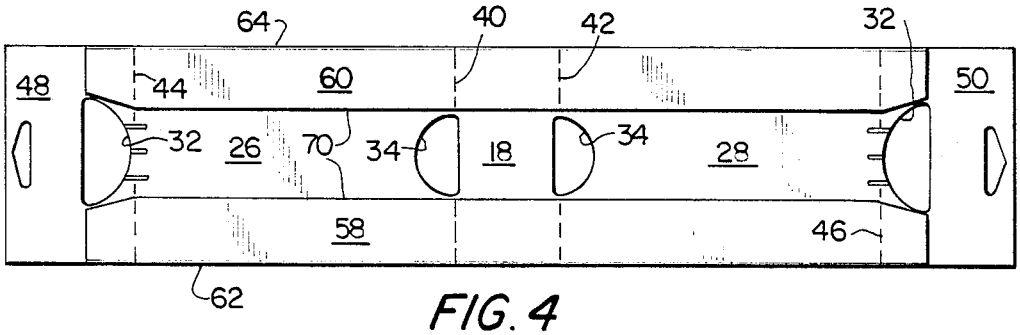
FIG. 4 is a top plan view of the blank of FIG. 3 with the reinforcing flaps overlying and secured to the respective carton panels.

A first embodiment of the display carton is illustrated in FIGS. 3 and 4. The unitary, planar blank 38 for forming the carton can be formed of any suitable paperboard material and is formed with bottom panel 18 generally in the center thereof. First and second side panels 26 and 28 extend from and are hingedly coupled to opposite end edges of the bottom panel along fold lines 40 and 42. First and second upper panels 22 and 24 extend from and are hingedly coupled to end edges of side panels 26 and 28, respectively, remote from bottom panel 18 along fold lines 44 and 46. First and second top display panels 48 and 50 extend from and are hingedly coupled to end edges of upper panels 22 and 24, respectively, remote from side panels 26 and 28 along fold lines 52 and 54. Each of these panels is generally rectangular in shape.

Top display panels 48 and 50 are provided with openings 56. Openings 56 are aligned when top display panels 48 and 50 overlie each other and are adhered to each other to form top panel 20. Openings 56 facilitate mounting of the display package on a hook or similar member for displaying the goods.

Openings 34 are located adjacent bottom panel 18 and are generally semicircular in shape. The diametrical border of each opening 34 is located generally along fold line 40 or fold line 42. Openings 32 are also semicircular. One opening 32 has a diametrical border generally along fold line 52, while the other opening 32 has a diametrical border generally along fold line 54.

Reinforcing flaps 58 and 60 extend from and are hingedly coupled to opposite side edges of upper panels 22 and 24, side panels 26 and 28, and bottom panel 18 along fold lines 62 and 64, respectively. Each reinforcing flap has a width in a direction perpendicular to fold lines 62 and 64 substantially equal to the spacing of openings 34 from fold lines 62 and 64 and the spacing of openings 32 from fold lines 62 and 64. Since openings 32 are somewhat larger than openings 34, the opposite ends of the reinforcing flaps have tapered portions 66 such that the reinforcing flaps will not interfere with the openings. Glue strips 68 of a suitable adhesive are formed on the interior surfaces of reinforcing flaps 58 and 60.

Fold lines 40, 42, 44 and 46 extend across respective panels and across the reinforcing flaps, as illustrated. Thus, the reinforcing flaps are continuous on each side of the panels and are separated into various sections by the panel fold lines. The fold lines in the reinforcing flaps are oriented in an opposite direction relative to the fold lines in the carton panels, when viewed in the position of FIG. 3.

Prior to wrapping display carton 12 about container 14, reinforcing flaps 58,60 are folded about lines 62 and 64 to overlie inner surfaces of upper panels 22 and 24, side panels 26 and 28, and bottom panel 18. The adhesive of strips 68 secure the reinforcing flaps to the panel inner surfaces. In this manner, as illustrated in FIG. 4, the free edges 70 of reinforcing flaps 58 and 60 lie adjacent the lateral ends of openings 32 and 34. The double thickness of material provided by the reinforcing flaps strengthens the display carton at its weakest points. Thus, the carton will not tear at the lateral edges of the openings, as experienced in conventional display cartons of this type. Additionally, the rounded edges provided at fold lines 62 and 64 will avoid the sharp edges found in conventional wrap-around display cartons.

Once the reinforcing flaps have been secured to the inner surfaces of the carton panels, the wrap-around display carton is secured about the container in the same manner employed for conventional wrap-around packages.

Figure 5:
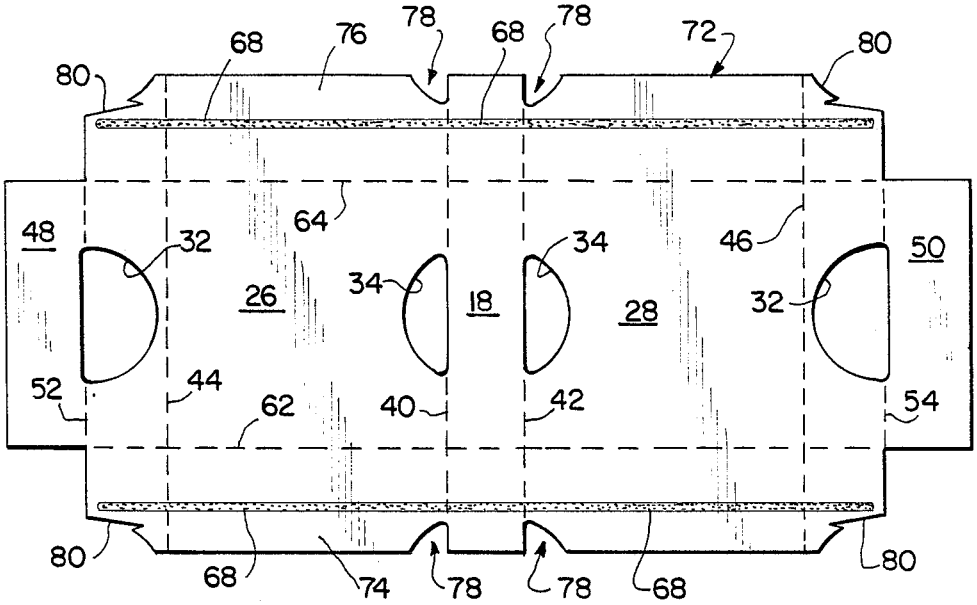
FIG. 5 is a top plan view of a blank for forming the display carton of FIG. 1 according to a second embodiment of the present invention.
Figure 6:
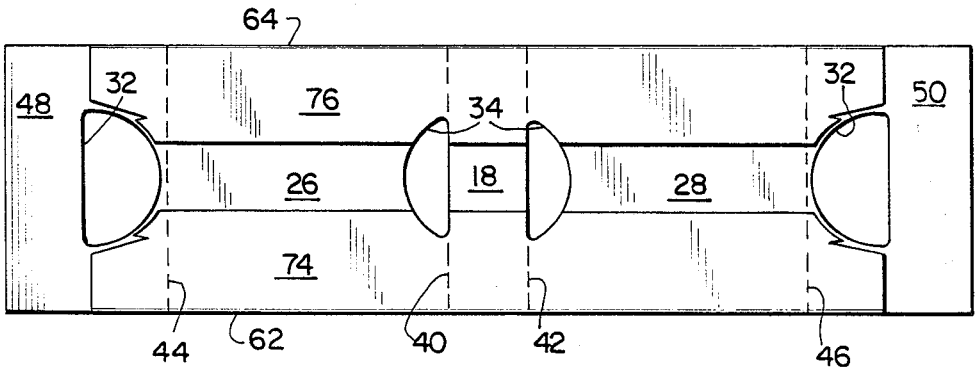
FIG. 6 is a top plan view of the blank of FIG. 5 with the reinforcing flaps overlying and secured to the respective carton panels.

FIGS. 5 and 6 display a second embodiment of the present invention formed by a blank 72. The portions of blank 72 which are substantially identical to the corresponding portions of blank 38 are identified with like reference numerals.

The difference between the first and second embodiments involves the form of the reinforcing flaps. In the second embodiment, reinforcing flaps 74 and 76 are somewhat wider in a direction perpendicular to fold lines 62 and 64 such that they have an overall width greater than the spacing of openings 32 and 34 from fold lines 62 and 64. To prevent the reinforcing flaps from covering portions of openings 32 and 34, edge recesses 78 extend laterally inwardly from the free edges of the reinforcing flaps adjacent fold lines 40 and 42. Additionally, end recesses 80 are formed at the longitudinal ends of the reinforcing flaps. Recesses 78 and 80 are aligned with openings 34 and 32, respectively. When reinforcing flaps 74 and 76 are folded about lines 62 and 64 to overlie and be secured to the inner surfaces of the carton panels, as illustrated in FIG. 6, the recesses will become aligned with and surround a significant portion of openings 32 and 34. Thus, greater portions of the peripheries of the openings are surrounded by a double thickness and are reinforced by the reinforcing flaps of the second embodiment.

The display carton of the second embodiment is closed in the same manner about the container as the first embodiment.

While various embodiments have been chosen to illustrate the invention, it will be understood by those skilled in the art that various changes and modifications can be made therein without departing from the scope of the invention as defined in the appended claims.

What is claimed is:

1. A display carton comprising:

(a) a pair of top display panels disposed in face-to-face contact and adhered together;

(b) a pair of upper panels connected to said top display panels along first fold lines, said upper panels depending from said top display panels;

(c) first openings formed in each of said upper panels closely adjacent to said first fold lines, said first openings being adapted to receive top edges of an article contained in said carton;

(d) a pair of side panels connected to said upper panels along second fold lines, said side panels depending from said upper panels;

(e) a bottom panel foldably connected to said side panels along third fold lines, said bottom panel connecting bottom edges of said side panels;

(f) second openings formed in each of said side panels closely adjacent to said third fold lines, said second openings being adapted to receive bottom edges of an article contained in said carton; and (g) a reinforcing flap foldably connected to each end edge of said carton, each reinforcing flap extending continuous and uninterrupted from one of said first fold lines along said upper panels, said side panels, and said bottom panel to the other of said first fold lines, and each of said reinforcing flaps being folded over its entirety into face-to-face contact with the inner surface of each of said upper, side and bottom panels and adhered thereto, said reinforcing flaps extending inwardly sufficiently to lie closely adjacent to and reinforce end edges of said first and second openings.

2. The display carton of claim 1 wherein said reinforcing flaps are locally contoured to conform to the shape of said first and second openings.

* * * * *